US009399559B2

(12) United States Patent
Xu et al.

(10) Patent No.: US 9,399,559 B2
(45) Date of Patent: Jul. 26, 2016

(54) PAPER MONEY TEMPORARY STORAGE DEVICE

(71) Applicant: GRG Banking Equipment Co., Ltd., Guangzhou, Guangdong (CN)

(72) Inventors: Huan Xu, Guangzhou (CN); Zhimin Li, Guangzhou (CN); Ying Han, Guangzhou (CN); Zhe Li, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 4 days.

(21) Appl. No.: 14/649,360

(22) PCT Filed: Jun. 28, 2013

(86) PCT No.: PCT/CN2013/078280

§ 371 (c)(1),
(2) Date: Jun. 3, 2015

(87) PCT Pub. No.: WO2014/089961

PCT Pub. Date: Jun. 19, 2014

(65) Prior Publication Data

US 2015/0307300 A1 Oct. 29, 2015

(30) Foreign Application Priority Data

Dec. 11, 2012 (CN) ..... 2012 1 0532471

(51) Int. Cl.
*B65H 5/28* (2006.01)
*B65H 29/00* (2006.01)
(Continued)

(52) U.S. Cl.
CPC ..... *B65H 29/006* (2013.01); *B65H 5/062* (2013.01); *B65H 5/068* (2013.01); *B65H 5/26* (2013.01);
(Continued)

(58) Field of Classification Search
CPC ..... B65H 5/28; B65H 29/006; B65H 29/008; B65H 2404/2611; B65H 2404/2612; B65H 2404/2613; B65H 2404/2615; B65H 2301/41912
See application file for complete search history.

(56) References Cited

U.S. PATENT DOCUMENTS 4,896,870 A 1/1990 Kobler
6,068,255 A 5/2000 Nicoll
(Continued)

FOREIGN PATENT DOCUMENTS

CN 1314298 A 9/2001
CN 1486917 A 4/2004
(Continued)

OTHER PUBLICATIONS

International Search Report dated Oct. 17, 2013 from corresponding International Application No. PCT/CN2013/078280.
(Continued)

*Primary Examiner* — Jeremy R Severson
(74) *Attorney, Agent, or Firm* — Wolf, Greenfield & Sacks, P.C.

(57) ABSTRACT

A banknote temporary storage device includes a pair of coiling tapes configured to clamp banknotes to be temporarily stored, a large coiling block configured to temporarily store the banknotes by accommodating the coiling tapes which clamp the banknotes to be temporarily stored, an upper coiling block component and a lower coiling block component configured to release or roll up the coiling tapes, and a banknotes inlet/outlet. Each of the coiling tapes has one end fixed onto the large coiling block, and another ends of the coiling tapes are respectively fixed onto the upper coiling block component and the lower coiling block component. The banknote temporary storage device is further provided with a coiling block guide plate and a pressing body, therefore the banknotes can be flattened when passing between the coiling block guide plate and the pressing body, thereby preventing the corners of the banknotes from being folded.

15 Claims, 2 Drawing Sheets

(51) Int. Cl.

| | |
|---|---|
| ***B65H 83/00*** | (2006.01) |
| ***B65H 5/06*** | (2006.01) |
| ***B65H 5/26*** | (2006.01) |
| ***B65H 5/34*** | (2006.01) |
| ***B65H 7/18*** | (2006.01) |
| ***B65H 7/20*** | (2006.01) |

(52) U.S. Cl.
CPC .. *B65H 5/28* (2013.01); *B65H 5/34* (2013.01); *B65H 7/18* (2013.01); *B65H 7/20* (2013.01); *B65H 83/00* (2013.01); *B65H 2301/41912* (2013.01); *B65H 2404/2613* (2013.01); *B65H 2701/1912* (2013.01)

(56) References Cited

U.S. PATENT DOCUMENTS

| | | | | |
|---|---|---|---|---|
| 2001/0022258 | A1 | 9/2001 | Satou et al. | |
| 2002/0096818 | A1* | 7/2002 | Mochizuki | B65H 5/28 271/18 |
| 2002/0113160 | A1* | 8/2002 | Niioka | B65H 29/0096 242/528 |
| 2013/0081922 | A1* | 4/2013 | Amo | B65H 29/006 194/206 |
| 2013/0240321 | A1* | 9/2013 | Kashiwabuchi | B65H 5/28 194/206 |
| 2014/0131164 | A1* | 5/2014 | Togiya | B65H 29/006 194/206 |

FOREIGN PATENT DOCUMENTS

| | | | |
|---|---|---|---|
| CN | 1843876 | A | 10/2006 |
| CN | 102044109 | A | 5/2011 |
| CN | 102963782 | A | 3/2013 |
| JP | 2006069708 | A | 3/2006 |

OTHER PUBLICATIONS

Written Opinion of the International Authority, dated Oct. 17, 2013, from corresponding International Application No. PCT/CN2013/078280.

* cited by examiner

PAPER MONEY TEMPORARY STORAGE DEVICE

This application is the national phase of International Application No. PCT/CN2013/078280, filed on Jun. 28, 2013, which claims the priority benefit of Chinese Patent Application No. 201210532471.8 titled "BANKNOTE TEMPORARY STORAGE DEVICE", filed with the Chinese State Intellectual Property Office on Dec. 11, 2012, which applications are hereby incorporated by reference to the maximum extent allowable by law.

TECHNICAL FIELD

The present application relates to the technical field of financial self-service equipment, and particularly to a banknote temporary storage device.

BACKGROUND

A banknote accommodating and discharging device can provide the function of temporarily storing banknotes. Banknotes enter into the device in the direction of its short side and are reeled up onto a large coiling block together with coiling tapes. The banknotes are stacked in layers on the large coiling block, which makes the outer diameter of the large coiling block gradually increase, thereby realizing the temporary storage function. Conversely, the banknotes wound on the large coiling block can be discharged into a passage through the reversing rotation of the coiling tapes and the large coiling block.

The banknote storage mechanism having such features may not be easily affected by the difference in widths of the banknotes. To prevent an oversized rotational inertia from being applied on the wheel of the coiling tapes, widths of the coiling tapes should be within a certain range. In addition, in the case that more than two pairs of the coiling tapes are used, the large coiling block may have inconsistent width after the banknotes are reeled up onto the large coiling block, which is highly possible to lead to warp of the banknotes; and thus it is preferably to use one pair of the coiling tapes.

However, since only one pair of thin coiling tapes is located at the central position of the large coiling block, the coverage of the coiling tapes for the banknotes is limited. Because of the limitation of the outer diameter of the large coiling block wrapped with the banknotes, an effective confined space is difficult to be formed between a rotation shaft of the large coiling block and an outer clamping roller of the coiling tapes, and a corner of the discharged banknotes may tilt upward to form a triangular folded corner. In view of this problem, in the bulletin of the Chinese Patent Application Publication No. CN1314298A (Application No. 01101724.4), a structure is provided, which includes a wheel for winding the coiling tape together with banknotes and provided at the center of a conveying passage, and a reel for winding the coiling tape sent out from the wheel, and further includes a guide device. As described in an example of the bulletin, a deformation roller in contact with the large coiling block presses the banknotes into wave shape to reduce the risk of forming triangular folded corners. However for the banknotes having slits outside the deformation roller, the wave shape of the banknotes can only be formed in the action range of the deformation roller and cannot be formed in the slit area, thus the banknotes are still apt to form triangle folded corners.

Therefore it is necessary to solve the problem that the banknotes may form folded corners in the banknote temporary storage device.

SUMMARY

A banknote temporary storage device is provided according to the present application, which may flatten an upward tilted portion of banknote, thereby preventing the problem that during the process of conveying banknote in the direction of its short side, four corners of the banknote or a slit portion of the banknote may tilt upwards to form folded corners or slits, which further affects the normal operation of the banknote temporary storage equipment.

The banknote temporary storage device includes a pair of coiling tapes configured to clamp banknotes to be temporarily stored, a large coiling block, an upper coiling block component and a lower coiling block component, and a banknotes inlet/outlet. Each of the coiling tapes has one end fixed onto the large coiling block, and the large coiling block is configured to temporarily store the banknotes by accommodating the coiling tapes which clamp the banknotes to be temporarily stored. Each of the coiling tapes has another end, and the another ends of the coiling tapes are respectively fixed onto the upper coiling block component and the lower coiling block component, and the upper coiling block component and the lower coiling block component are configured to release or roll up the coiling tapes in a case that it is required to temporarily store or discharge the banknotes. The banknotes inlet/outlet includes an upper passage board, a lower passage board and a pair of engaged clamping rollers, the upper passage plate and the lower passage board are oppositely arranged to form a banknote conveying passage, the pair of engaged clamping rollers includes an upper clamping roller and a lower clamping roller, the upper clamping roller is arranged at one end, close to the coiling tapes, of the upper passage board, and the lower clamping roller is arranged at one end, close to the coiling tapes, of the lower passage board, and the pair of coiling tapes is divided into two coiling tapes after passing through a position where the upper clamping roller engages with the lower clamping roller, the two coiling tapes are respectively wound through the upper clamping roller and the lower clamping roller and then are respectively fixed onto the upper coiling block component and the lower coiling block component. The banknote temporary storage device further includes a coiling block guide plate and a pressing body configured to cooperate with the coiling block guide plate, one end of the coiling block guide plate is arc-shaped and is configured to always cling tightly to a periphery of the large coiling block, and another end of the coiling block guide plate is connected to the lower clamping roller, and the pressing body is configured to engage with the coiling block guide plate at the middle of the coiling block guide plate.

Specifically, a spring is connected to the end of the coiling block guide plate clinging to the periphery of the large coiling block, and is configured to provide an elastic force for the coiling block guide plate, to make the coiling block guide plate to always cling tightly to the periphery of the large coiling block.

Preferably, the coiling block guide plate is configured to be swingable around a rotating shaft of the lower clamping roller.

Optionally, the pressing body and the coiling block guide plate are configured to swing at the same time.

Optionally, the pressing body is fixedly arranged.

Preferably, a line of clamping direction of the banknote before and after the banknote passing through an engaging point of the coiling block guide plate and the pressing body is set to have an inclination angle $\alpha$, and the engaging point is provided at a position as close to the pair of clamping rollers as possible.

Preferably, the inclination angle $\alpha$ is required to meet the formula: $180°-\arctan(1/\mu)<\alpha<180°$, wherein $\mu$ is a frictional coefficient between the banknote and the coiling block guide plate.

The banknote temporary storage device according to the present application is provided with a coiling block guide plate and a pressing body for cooperating with the coiling block guide plate, therefore the banknotes can be flattened when passing between the coiling block guide plate and the pressing body, thereby preventing the corners of the banknotes from being folded.

BRIEF DESCRIPTION OF THE DRAWINGS

The present application is further described in conjunction with drawings and embodiments hereinafter.

DETAILED DESCRIPTION

Technical solutions according to embodiments of the present application are clearly and completely described hereinafter in conjunction with the drawings.

Figure 4:
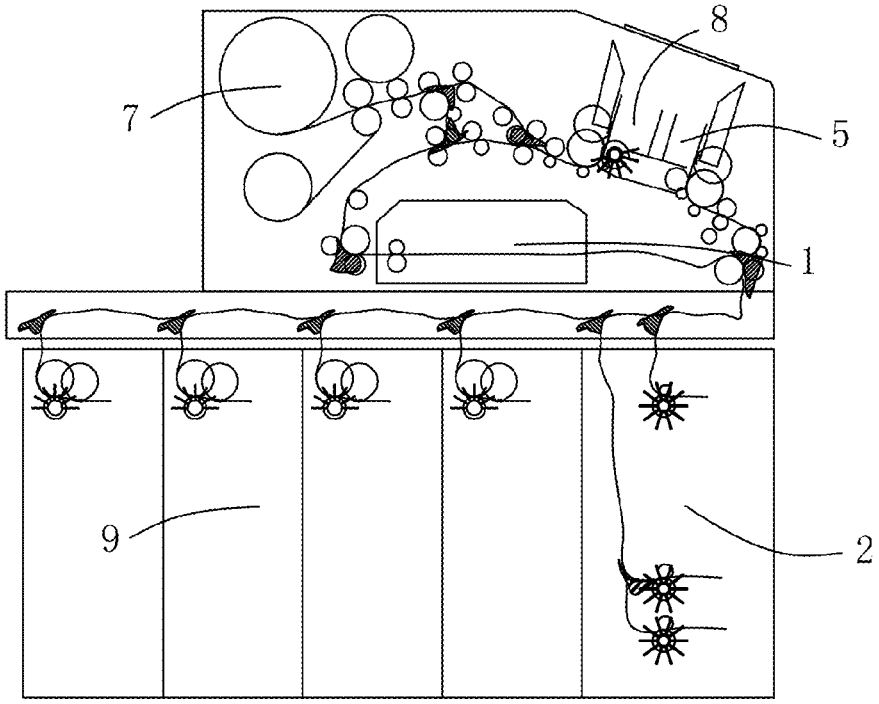
FIG. 4 is a partial sectional view of a preferred embodiment of a financial self-service equipment which adopts the banknote temporary storage and discharge device shown in FIG. 1 according to the present application.

FIG. 4 is a sectional view of a financial self-service equipment for depositing and withdrawing, and the financial self-service equipment is taken as an example to illustrate the trading process for depositing and withdrawing banknotes.

A banknotes depositing process is described as follows. After banknotes are placed in a depositing port 5, the banknotes are separated by a banknote separating device and then enter into a banknote identifying device 1 piece by piece. Unqualified banknotes will be rejected and returned to a withdrawing port 8, to be taken away by a customer or to be accommodated into a cashbox 2 only for depositing, and qualified banknotes will enter into a banknote temporary storage device 7. When the customer confirms to deposit the banknotes, the qualified banknotes will enter into a cashbox 9 from the banknote temporary storage device 7, thereby complementing one banknote depositing process.

A banknote withdrawing process is described as follows. When a customer gives a banknote withdrawing command, banknotes are separated from the cashbox 9 and conveyed into a passage. After the banknotes are identified by the banknote identifying device 1, qualified banknotes enter into the depositing port 8, and unqualified banknotes enter into the banknote temporary storage device 7 and then are accommodated into the cashbox 2 only for depositing when the withdrawing process is completed.

As illustrated above, the banknote temporary storage device 7 of this embodiment is used to temporarily accommodate banknotes before the banknotes are stored in the cashbox 9.

An implementation adaptive to the banknote temporary storage device 7 of the present application is illustrated hereinafter.

Figure 1:
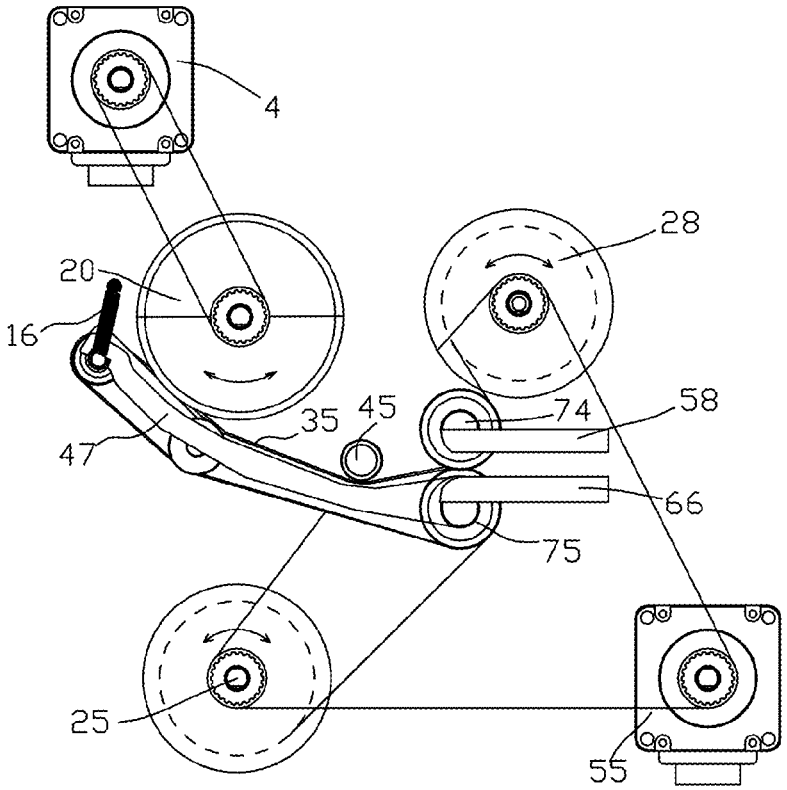
FIG. 1 is a side view of a preferred embodiment of a banknote temporary storage device according to the present application.
Figure 2:
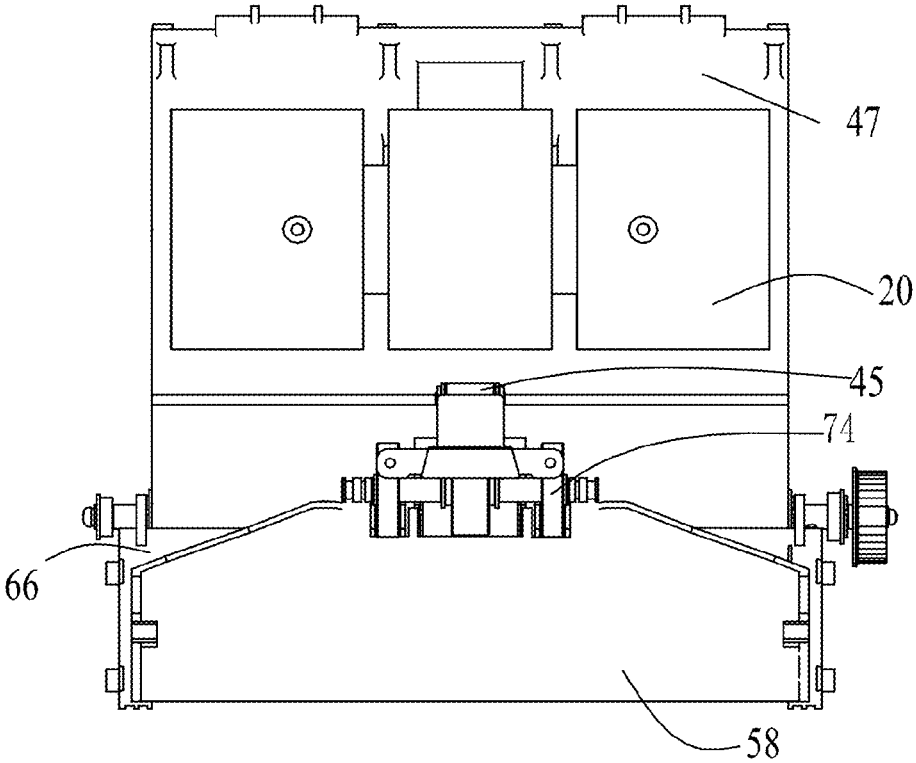
FIG. 2 is a plane view showing an initial stage of an accommodating state of the banknote temporary storage device.

FIG. 1 is a side view showing the structure of the banknote temporary storage device 7 at an initial stage of the accommodating state, and FIG. 2 is a plane view showing the structure of the banknote temporary storage device 7 at the initial stage of the accommodating state. The banknote temporary storage device 7 includes a large coiling block 20, a first motor 4 for driving the large coiling block, an upper coiling block component 28, a lower coiling block component 25, a second motor 55 for driving the upper coiling block component 28 and the lower coiling block component 25 at the same time, a pair of coiling tapes 35 and a coiling block guide plate 47 which are provided for clamping and guiding, and a pair of engaged clamping rollers 74 provided at a position where the coiling tapes 35 joins with an upper passage board 58 and a lower passage board 66. The pair of clamping rollers includes an upper clamping roller 74 and a lower clamping roller 75.

The pair of coiling tapes 35 is wound around the large coiling block 20, the upper coiling block component 28 and the lower coiling block component 25. Specifically, the pair of coiling tapes 35 includes two coiling tapes and can clamp the banknotes. Each of the two coiling tapes has one end fixed on the large coiling block 20, and the ends, fixed on the large coiling block 20, of the two coiling tapes are configured to be reeled up or released by the large coiling block 20 at the same time. Each of the two coiling tapes has another end, and the another ends of the two coiling tapes are respectively wound around the upper coiling block component 28 and the lower coiling block component 25, and before being respectively wound around the upper coiling block component 28 and the lower coiling block component 25, the two coiling tapes are respectively wound through the upper clamping roller 74 and the lower clamping roller 75 engaging with each other, thus the pair of coiling tapes 35 is separated into two coiling tapes at the position where the upper clamping roller 74 engages with the lower clamping roller 75, and the two coiling tapes are respectively released or reeled up by the upper coiling block component 28 and a lower coiling block component 25. In addition, a banknote inlet/outlet is formed at the position where the upper clamping roller 74 engages with the lower clamping roller 75 by the coiling tapes 35 together with the upper passage board 58, the lower passage board 66, the upper clamping roller 74 and the lower clamping roller 75. The upper passage board 58 and the lower passage board 66 are oppositely arranged to form a banknote conveying passage, and the banknote temporary storage device 7 enters into an accommodating state when the banknotes enter from the upper passage board 58 and the lower passage board 66. The banknotes are clamped by the coiling tapes 35 and guided by the coiling block guide plate 47 onto the large coiling block 20, and are stacked in layers together with the coiling tapes 35. One end of the coiling block guide plate 47 always clings to the outmost layer of the combination of the large coiling block 20, the coiling tapes 35 and the banknotes, and this end is formed by an arc having a diameter slightly larger than the maximum diameter of the large coiling block 20 when the maximum number of sheets of banknotes are accommodated at the periphery of the large coiling block 20, and the coiling block guide plate 47 is tensioned by a spring 16 to ensure the fitting force. The other end of the coiling block guide plate 47 is connected to the lower clamping roller.

The banknote temporary storage device 7 may accomplish the accommodation of banknotes through the above procedures. The banknote discharging process is illustrated hereinafter.

Figure 3:
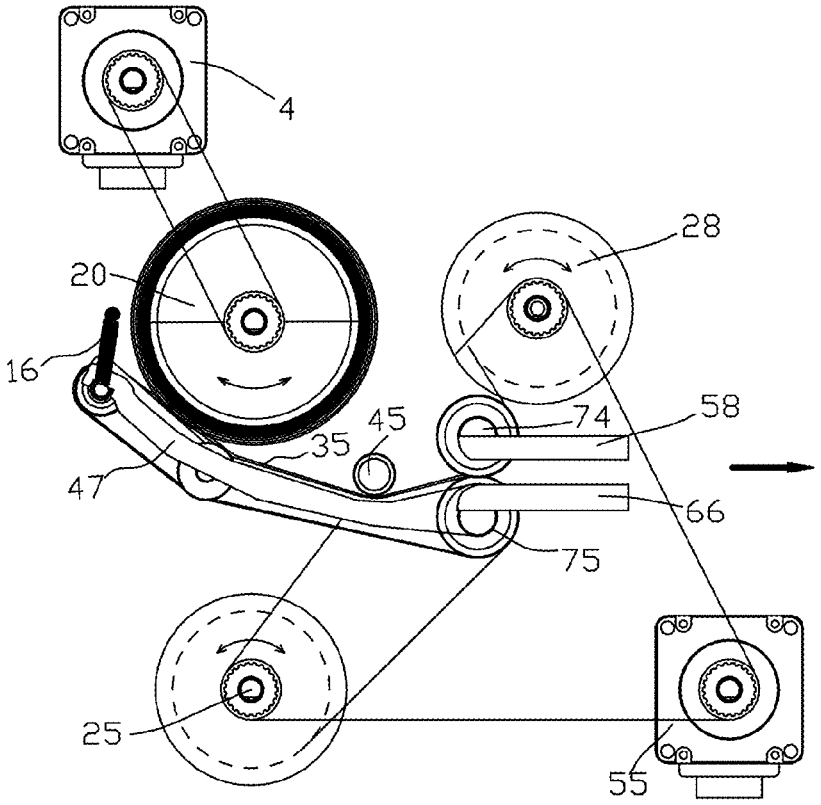
FIG. 3 is a side view showing an initial stage of a banknote discharging state of the banknote temporary storage device.

FIG. 3 is a state view of the banknote temporary storage device 7 after the banknote storage process is accomplished. The first motor 4 and the second motor 55 simultaneously drive the large coiling block 20 to rotate anticlockwise and drive the upper coiling block component 28 and the lower coiling block component 25 to rotate clockwise, respectively, to discharge the banknotes.

During the banknote discharging process, the state of the accommodated banknotes cannot be completely controlled, for example, the discharged banknotes sometimes have features such as upward titled corners or slits, thus when such kind of banknote is conveyed to an entrance of the passage, the upward titled portion of the banknote is apt to collide with the upper passage board 58, causing the corner of the banknote to be folded into a triangular fold, thus the banknote temporary storage device cannot normally discharge banknotes, in this case, not only the whole operation of the device has to stop, but also the recovery process wastes a lot of time.

For solving the above problems, as shown in FIG. 1 to FIG. 3, the banknote temporary storage device 7 according to this embodiment also includes a pressing body 45 cooperating with the coiling block guide plate 47. The pressing body 45 engages with the coiling block guide plate 47 at the middle of the coiling block guide plate 47, and the coiling tapes 35 are clamped between the pressing body 45 and the coiling block guide plate 47 at the engaging point of the pressing body 45 and the coiling block guide plate 47, that is, the coiling tapes 35 pass through the engaging point of the coiling block guide plate 47 and the pressing body 45, hence the banknotes will be flattened when passing through the engaging point of the coiling block guide plate 47 and the pressing body 45. Therefore, even if the banknote has slits or tilted four corners after leaving the large coiling block 20, the four tilted corners of the banknote will be flattened to cling as close to the coiling block guide plate 47 as possible when the banknote passes through the engaging point of the coiling block guide plate 47 and the pressing body 45, and the banknotes can be normally discharged.

Furthermore, in order to flatten the banknote having four titled corners, a line of clamping direction of the banknote before and after the banknote passing through the engaging point of the coiling block guide plate 47 and the pressing body 45 is set to have an inclination angle $\alpha$, and the engaging point is preferably at a position as close to the clamping rollers 74 and 75 at the tail ends of the coiling tapes as possible.

Besides, for realizing the above object, since the coiling block guide plate 47 is configured to be swingable around the rotating shaft of the clamping roller 75, the pressing body 45 may be configured to swing simultaneously with the coiling block guide plate 47, or may also be arranged at a fixed position. However, no matter which method is adopted to fix the pressing body 45, it is required to set the line of clamping direction of banknote before and after the banknote passing through the engaging point of the coiling block guide plate 47 and the pressing body 45 to have the inclination angle $\alpha$ at any time.

To realize the above object, the inclination angle $\alpha$ of the coiling block guide plate is required to meet the following formula:

$$\alpha<180° \quad \text{(formula 1).}$$

Meanwhile, if the angle $\alpha$ is too small, a frictional force generated between the banknotes and the coiling block guide plate 47 increases, and it is possible to cause conveying obstacles such as banknotes jam. Thus, supposing the frictional coefficient between the banknotes and the coiling block guide plate 47 is $\mu$, the angle $\alpha$ is required to meet the following formula:

$$\alpha>180°-\arctan(1/\mu) \quad \text{(formula 2);}$$

That is, preferably, the inclination angle $\alpha$ is required to meet both the formula 1 and the formula 2.

As known from realistic simulation, the angle $\alpha$ having a value close to the lower limit of the prescribed range is more beneficial for solving the problem of discharging the banknotes having tilted portions.

The invention claimed is:

1. A banknote temporary storage device, comprising:

a pair of coiling tapes, configured to clamp banknotes to be temporarily stored;

a large coiling block, wherein each of the coiling tapes has one end fixed onto the large coiling block, and the large coiling block is configured to temporarily store the banknotes by accommodating the coiling tapes which clamp the banknotes to be temporarily stored;

an upper coiling block component and a lower coiling block component, wherein each of the coiling tapes has another end, the another ends of the coiling tapes are respectively fixed onto the upper coiling block component and the lower coiling block component, and the upper coiling block component and the lower coiling block component are configured to release or roll up the coiling tapes in a case that it is required to temporarily store or discharge the banknotes; and a banknotes inlet/outlet, comprising an upper passage board, a lower passage board and a pair of engaged clamping rollers, the upper passage plate and the lower passage board being oppositely arranged to form a banknote conveying passage, the pair of engaged clamping rollers comprising an upper clamping roller and a lower clamping roller, the upper clamping roller being arranged at one end, close to the coiling tapes, of the upper passage board, and the lower clamping roller being arranged at one end, close to the coiling tapes, of the lower passage board, and the pair of coiling tapes being divided into two coiling tapes after passing through a position where the upper clamping roller engages with the lower clamping roller, the two coiling tapes being respectively wound through the upper clamping roller and the lower clamping roller and then being respectively fixed onto the upper coiling block component and the lower coiling block component; wherein, the banknote temporary storage device further comprises a coiling block guide plate and a pressing body configured to cooperate with the coiling block guide plate, one end of the coiling block guide plate is arc-shaped and is configured to always cling tightly to a periphery of the large coiling block, and another end of the coiling block guide plate is connected to the lower clamping roller, and the pressing body is configured to engage with the coiling block guide plate at the middle of the coiling block guide plate.

2. The banknote temporary storage device according to claim 1, wherein a spring is connected to the end of the coiling block guide plate clinging to the periphery of the large coiling block, and is configured to provide an elastic force for the coiling block guide plate, to make the coiling block guide plate to always cling tightly to the periphery of the large coiling block.

3. The banknote temporary storage device according to claim 2, wherein a line of clamping direction of the banknote before and after the banknote passing through an engaging point of the coiling block guide plate and the pressing body is set to have an inclination angle $\alpha$, and the engaging point is provided at a position close to the pair of clamping rollers.

4. The banknote temporary storage device according to claim 3, wherein the inclination angle $\alpha$ is required to meet the formula: $180°-\arctan(1/\mu)<\alpha<180°$, wherein $\mu$ is a frictional coefficient between the banknote and the coiling block guide plate.

5. The banknote temporary storage device according to claim 1, wherein the coiling block guide plate is configured to be swingable around a rotating shaft of the lower clamping roller.

6. The banknote temporary storage device according to claim 5, wherein the pressing body and the coiling block guide plate are configured to swing at the same time.

7. The banknote temporary storage device according to claim 6, wherein a line of clamping direction of the banknote before and after the banknote passing through an engaging point of the coiling block guide plate and the pressing body is set to have an inclination angle $\alpha$, and the engaging point is provided at a position close to the pair of clamping rollers.

8. The banknote temporary storage device according to claim 7, wherein the inclination angle $\alpha$ is required to meet the formula: $180°-\arctan(1/\mu)<\alpha<180°$, wherein $\mu$ is a frictional coefficient between the banknote and the coiling block guide plate.

9. The banknote temporary storage device according to claim 5, wherein the pressing body is fixedly arranged.

10. The banknote temporary storage device according to claim 9, wherein a line of clamping direction of the banknote before and after the banknote passing through an engaging point of the coiling block guide plate and the pressing body is set to have an inclination angle $\alpha$, and the engaging point is provided at a position close to the pair of clamping rollers.

11. The banknote temporary storage device according to claim 10, wherein the inclination angle $\alpha$ is required to meet the formula: $180°-\arctan(1/\mu)<\alpha<180°$, wherein $\mu$ is a frictional coefficient between the banknote and the coiling block guide plate.

12. The banknote temporary storage device according to claim 5, wherein a line of clamping direction of the banknote before and after the banknote passing through an engaging point of the coiling block guide plate and the pressing body is set to have an inclination angle $\alpha$, and the engaging point is provided at a position close to the pair of clamping rollers.

13. The banknote temporary storage device according to claim 12, wherein the inclination angle $\alpha$ is required to meet the formula: $180°-\arctan(1/\mu)<\alpha<180°$, wherein $\mu$ is a frictional coefficient between the banknote and the coiling block guide plate.

14. The banknote temporary storage device according to claim 1, wherein a line of clamping direction of the banknote before and after the banknote passing through an engaging point of the coiling block guide plate and the pressing body is set to have an inclination angle $\alpha$, and the engaging point is provided at a position close to the pair of clamping rollers.

15. The banknote temporary storage device according to claim 14, wherein the inclination angle $\alpha$ is required to meet the formula: $180°-\arctan(1/\mu)<\alpha<180°$, wherein $\mu$ is a frictional coefficient between the banknote and the coiling block guide plate.

* * * * *